US006155193A

United States Patent [19]

Syvertsen et al.

[11] Patent Number: 6,155,193

[45] Date of Patent: Dec. 5, 2000

[54] VESSEL FOR USE IN THE PRODUCTION AND/OR STORAGE OF HYDROCARBONS

[75] Inventors: Kare Syvertsen, Arendal; Per Skiftesvik, Bergen, both of Norway

[73] Assignee: Den Norske Stats Oljeselskap A.S., Stavanger, Norway

[21] Appl. No.: 09/367,548

[22] PCT Filed: Feb. 19, 1998

[86] PCT No.: PCT/NO98/00050

§ 371 Date: Oct. 29, 1999

§ 102(e) Date: Oct. 29, 1999

[87] PCT Pub. No.: WO98/36964

PCT Pub. Date: Aug. 27, 1998

[30] Foreign Application Priority Data

Feb. 20, 1997 [NO] Norway ..... 970793

[51] Int. Cl.[7] ..... B63B 22/02

[52] U.S. Cl. ..... 114/230.12; 441/5

[58] Field of Search ..... 114/230.1, 230.12, 114/230.13; 441/3.5

[56] References Cited

U.S. PATENT DOCUMENTS 4,321,720 3/1982 Havre ..... 441/5

5,540,607 7/1996 Breivik et al. ..... 441/5

FOREIGN PATENT DOCUMENTS 2050995 1/1981 United Kingdom .

2103745 2/1983 United Kingdom .

*Primary Examiner*—Stephen Avila

*Attorney, Agent, or Firm*—Pitney, Hardin, Kipp & Szuch, LLP

[57] ABSTRACT

A vessel for use in the production and/or storage of hydrocarbons, including a receiving device having a downwardly open space for receiving and releasably securing a submerged buoy connected to at least one riser, a rotatable connector for connection with the buoy and transfer of fluids, and a dynamic positioning system for keeping the vessel at a desired position. The vessel includes a moonpool extending through the hull, and the receiving device is a unit which is arranged in the moonpool for raising and lowering, the rotatable connector being arranged at deck level, for connection to the buoy when the receiving unit with the buoy has been raised to an upper position in the moonpool.

5 Claims, 3 Drawing Sheets

VESSEL FOR USE IN THE PRODUCTION AND/OR STORAGE OF HYDROCARBONS

Figure 1:
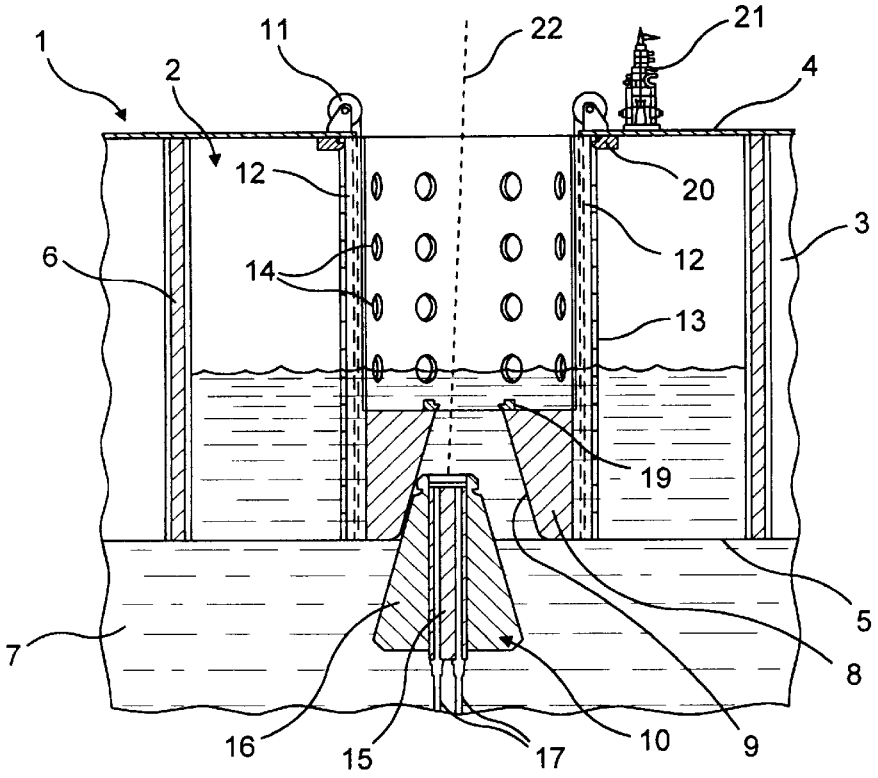

The invention relates to a vessel for use in the production and/or storage of hydrocarbons, comprising a receiving means having a downwardly open space for receiving and releasably securing a submerged buoy connected to at least one riser, a rotatable connector for connection with the buoy and transfer of fluids, and a dynamic positioning system for keeping the vessel at a desired position.

There are previously known a number of different types and embodiments of vessels for use in the production, storage and transport of hydrocarbons from offshore fields. The known vessels of the type to which the invention relates, are based on the so-called STP concept, wherein the abbreviation "STP" stands for "Submerged Turret Production". For a further description of STP systems reference can, for example, be made to Norwegian laying-open print 176 129 and Norwegian patent 177 778.

The known vessels of the topical type comprise a submerged, downwardly open receiving space which is preferably arranged in the bow portion of the vessel and is arranged for receiving a bottom-anchored underwater buoy for the transfer for hydrocarbons, and a service shaft extending between the receiving space and the deck of the vessel. At the lower end of the service shaft there is arranged a rotating coupling device or so-called connector for connection of the buoy to a pipe system on the vessel. The connector is movably arranged, to be able to be moved away from the shaft to a parking position when it is not in use.

Thus, these known constructions are based on a submerged receiving space (STP space) which is arranged at the lower end of a service shaft, and on a rotating connector which is arranged at the lower end of the shaft. This implies that the shaft will be partly filled with water in connection and disconnection of the buoy, and that the service shaft after these operations must be emptied of water to get a dry access to the equipment at the lower end of the shaft. Even if the STP concept affords great operational and security advantages in relation to previously known solutions, the submerged environment in connection with the receiving space implies that special structural considerations must be taken which complicate some of the structural details.

An object of the present invention is to provide a new solution giving the possibility for structural simplifications, at the same time as it results in an easy access to the structural units, with a view to easy installation and maintenance.

Another object of the invention is to provide a solution enabling the use of the STP concept of the existing drilling or production ships, or other floating production systems, which are provided with a moonpool and are dynamically positioned.

The above-mentioned objects are achieved with a vessel of the introductorily stated type, which, according to the invention, is characterized in that it comprises a moonpool extending through the hull of the vessel from the bottom up to the deck level thereof, and that the receiving means is a unit which is raisably and lowerably arranged along the length of the moonpool, the rotatable connector being arranged at deck level, for direct connection to the buoy when the receiving unit with the buoy has been raised to an upper position at the top of the moonpool.

Thus, the solution according to the invention takes it starting point in the STP concept with a submerged STP buoy and a rotating connector. The main difference resides in that the buoy after pulling-in is mounted at deck level (at the "tank top") instead of in a submerged space at the bottom of the vessel. A presupposition is here that the vessel is kept in position by means of a dynamic positioning system, so that the buoy does not need to be bottom-anchored.

By means of the solution according to the invention there is achieved that a rotating connector is placed at a "dry" place, with an easy access for installation and maintenance. Further, all connections to the connector can be carried out at deck level. The problems connected to the STP space are considerably simplified because of a simpler construction and a more easy accessibility to equipment in the space. Further, inspection of riser terminations can be carried out more easily. The submerged buoy possibly may also be of a simpler structure as compared to the existing structures since, as mentioned, it is the question of a dynamically positioned vessel wherein the buoy does not need to take up anchor chains and load in this connection.

The invention also gives the possibility for utilization of existing drilling of production vessels which are already equipped with a moonpool, but which are not built for the receipt of an STP buoy in a submerged receiving space, since the moonpool in a relatively simple manner can be provided with the receiving unit according to the invention.

Figure 3:
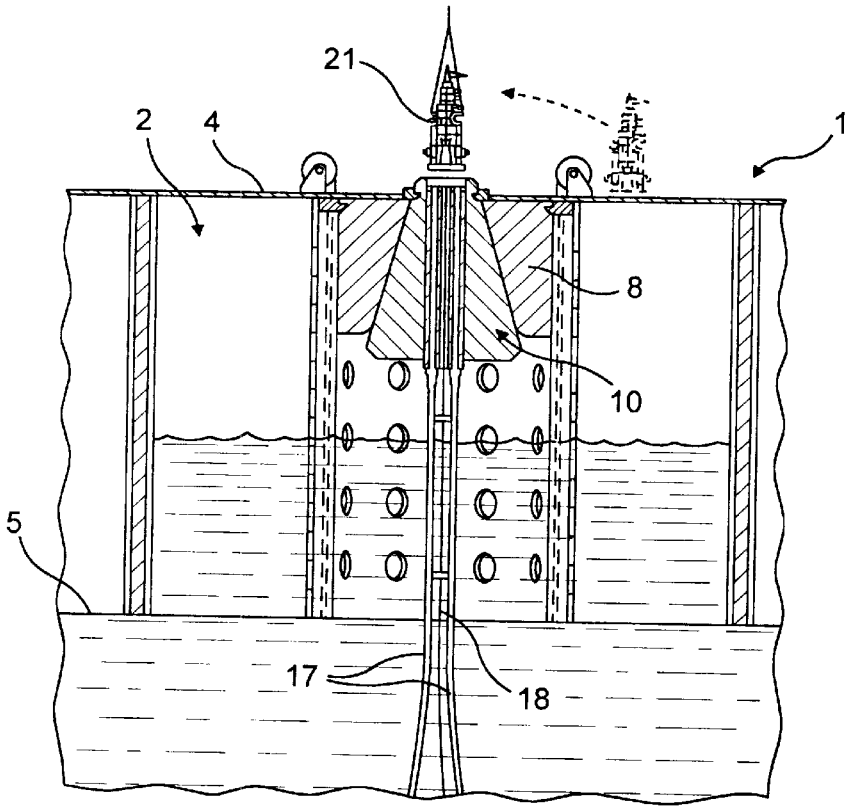
Figure 4:
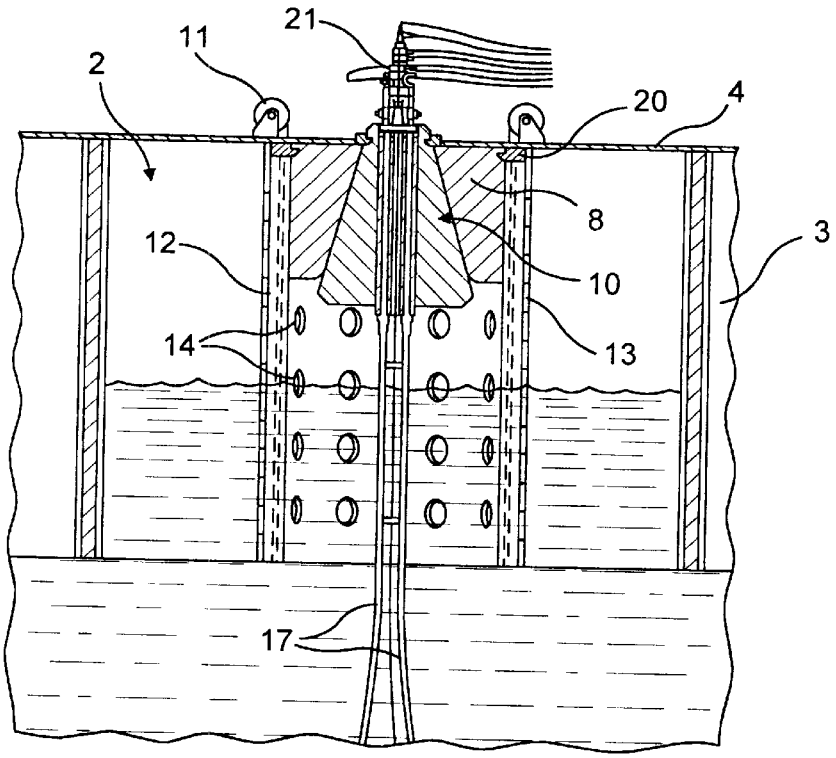
Figure 5:
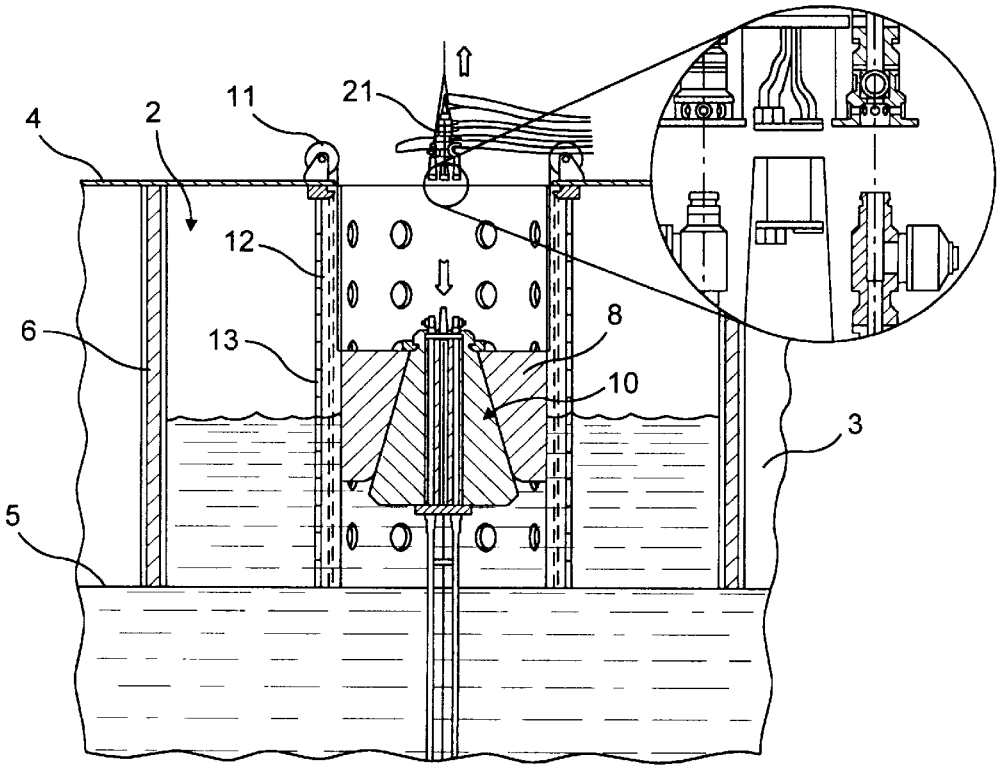

The invention will be further described below in connection with an exemplary embodiment with reference to the drawings, wherein FIGS. 1–6 show schematic sectional side views of a part of a vessel which is provided with the structure according to the invention, the Figures showing various operational phases in connection with pulling-in, mounting and release of a submerged buoy, and wherein FIG. 5 also shows an enlarged detail of the rotating connector.

As appears, the drawing figures show schematic sectional views of a segment of a floating vessel 1 which is provided with a moonpool 2 extending vertically through the vessel hull 3 between the deck 4 and the bottom 5 of the vessel. The moonpool is limited by a wall 6. The ship floats in a body of water 7 filling the moonpool up to a level corresponding to the draught of the ship.

In accordance with the invention, a receiving means for a buoy is arranged in the moonpool, the receiving means being raisably and lowerably arranged in the moonpool. The receiving means is a unit 8 which is shown as a block having a tapering, conical opening 9 which is adapted to receive a buoy 10 having a corresponding outer shape. In the shown embodiment the receiving unit 8 is raisable and lowerable by means of winches 11 arranged on the deck 4 of the vessel. The movement of the receiving unit is guided by vertical rails 12, e.g. strong I-beams, extending between the deck 4 and the bottom 5 of the vessel. The rails are fastened to the inner side of the wall 13 of a cylinder arranged centrally in the moonpool. The cylinder suitably has a circularly cylindrical cross section, and the rails are constituted by a pair of rails which are fastened to diametrically opposite places on the inner side of the cylinder wall. As shown, the cylinder wall is provided with a great number of perforating openings 14 which are arranged in order to damp or equalize waves in the moonpool.

As regards the buoy 10, this is of the two-part type consisting of a central member 15 and an outer buoyancy member 16 which is rotatably mounted on the central member. The central member supports the topical number of risers 17 and umbilicals 18. The outer member 16 is adapted to be releasably fastened in the opening 9 by means of a conventional hydraulic/mechanic locking mechanism 19 which can be operated from the deck of the vessel. On a level with the deck of the vessel there are arranged similar locking mechanisms 20 for the locking of the receiving unit 8 when this has been raised to its upper position in the moonpool by means of the winches 11.

A rotating connecting device or connector 21 for interconnection with the buoy is arranged on the deck 4 of the vessel. The connector in the usual manner is provided with a number of courses for the transfer of the production fluids and possible other topical fluids, and with suitable swivel means for the transfer of hydraulic or electrical control signals, and possibly also electric power to subsea places of use. The rotating connector for example may be of the type which is disclosed in patent application No. 953095.

Figure 6:
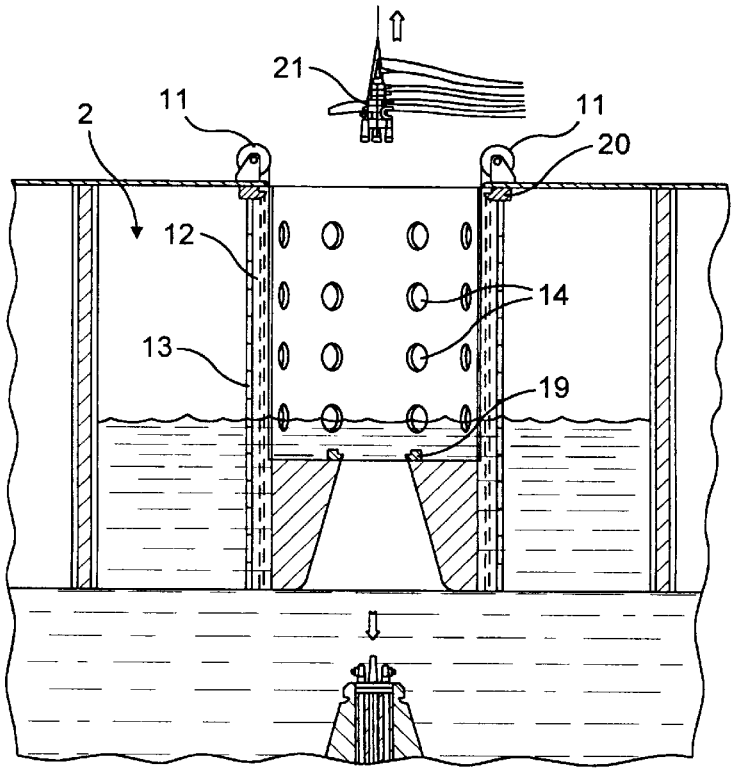

In operation the connector is of course connected to the necessary pipelines and cables, as appears from FIGS. 4–6.

FIG. 5 also shows an enlarged detail showing an embodiment of the structural design of the lower part of the connector and cooperating parts at the top of the topical buoy.

Figure 2:
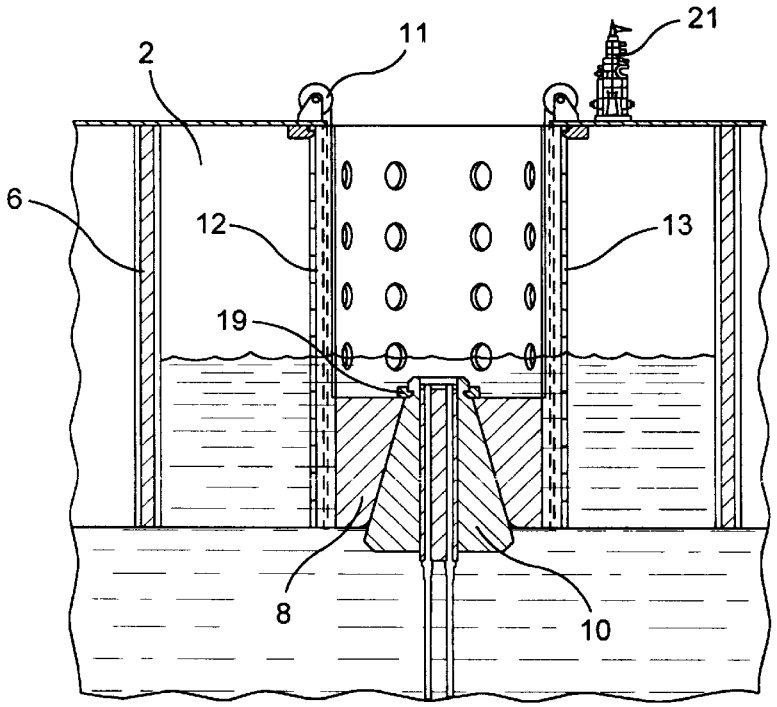

In the operational phase shown in FIG. 1, the buoy 10 with associated risers etc. is about to be pulled into the opening 9 of the receiving unit 8 by means of a pick-up line 22 connected to a non-illustrated winch. The receiving unit then is situated at its lower position. When the buoy is in place in the opening 9, it is locked by means of the locking mechanism 19, as shown in FIG. 2. The buoy with the riser system and the receiving unit 8 thereafter is lifted to deck level and locked there by means of the locking mechanism 20, as shown in FIG. 3.

After the buoy is locked at deck level, the rotating connector 21 is installed at the top of the buoy. The connector can be lifted in place on the buoy by means of a crane or a carriage guided on rails on the deck. These units are not shown in the drawings. After the connector is installed, the system is prepared for production, as shown in FIG. 4, and the production starts.

When required, the buoy can be quickly released from the connector, the locking mechanism 20 then releasing the receiving unit 8, so that this unit and the buoy sink down, controlled by the winches 11, towards the lower position of the receiving unit. When the receiving unit 8 with the buoy is in the lower position, or possibly during lowering of the unit, the buoy is released from the receiving unit by means of the locking mechanism 19, so that the buoy falls out of the opening and sinks in the water. This situation is shown in FIG. 6.

What is claimed is:

1. A vessel for use in the production and/or storage of hydrocarbons, comprising a receiving means (8) having a downwardly open space (9) for receiving and releasably securing a submerged buoy (10) connected to at least one riser (17), a rotatable connector (21) for connection with the buoy (10) and transfer of fluids, and a dynamic positioning system for keeping the vessel (1) at a desired position, CHARACTERIZED IN that it comprises a moonpool (2) extending through the hull of the vessel (1) from the bottom up to the deck level thereof, and that the receiving means is a unit (8) which is raisably and lowerably arranged along the length of the moonpool, the rotatable connector (21) being arranged at deck level, for direct connection to the buoy when the receiving unit with the buoy has been raised to an upper position at the top of the moonpool.

2. A vessel according to claim 1, CHARACTERIZED IN that the receiving unit (8) is raisable and lowerable by means of winches (11) arranged on the deck (4) of the vessel.

3. A vessel according to claim 1 or 2, CHARACTERIZED IN that the movement of the receiving unit (8) is guided by vertical rails (12) extending between an upper and a lower end of the moonpool (2) and being fixed in relation thereto.

4. A vessel according to claim 3, CHARACTERIZED IN that the rails are constituted by a pair of rails (12) which are fastened to diametrically opposite places on the inner side of a vertical circularly cylindrical wall (13).

5. A vessel according to claim 4, CHARACTERIZED IN that the cylinder wall (13) is perforated to allow flow-through of water.

* * * * *